US010395614B2

(12) United States Patent
Cao

(10) Patent No.: US 10,395,614 B2
(45) Date of Patent: Aug. 27, 2019

(54) COMMON VOLTAGE GENERATING CIRCUIT AND LCD

(71) Applicant: Shenzhen China Star Optoelectronics Technology Co., Ltd., Shenzhen, Guangdong (CN)

(72) Inventor: Dan Cao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/570,217

(22) PCT Filed: Jul. 26, 2017

(86) PCT No.: PCT/CN2017/094549
§ 371 (c)(1),
(2) Date: Oct. 27, 2017

(87) PCT Pub. No.: WO2018/232830
PCT Pub. Date: Dec. 27, 2018

(65) Prior Publication Data

US 2018/0374438 A1 Dec. 27, 2018

(30) Foreign Application Priority Data

Jun. 22, 2017 (CN) ..... 2017 1 0481709

(51) Int. Cl.
*G09G 3/36* (2006.01)

(52) U.S. Cl.
CPC ..... *G09G 3/3655* (2013.01); *G09G 3/3614* (2013.01); *G09G 3/3677* (2013.01);
(Continued)

(58) Field of Classification Search
CPC ... G09G 3/3655; G09G 3/3677; G09G 3/3688
See application file for complete search history.

(56) References Cited

U.S. PATENT DOCUMENTS 6,278,429 B1 * 8/2001 Ruth ..... G09G 3/3629 345/208
6,977,640 B1 * 12/2005 Baek ..... G09G 3/3611 345/102
(Continued)

FOREIGN PATENT DOCUMENTS

CN 1908741 A 2/2007
CN 101206354 A 6/2008
(Continued)

OTHER PUBLICATIONS

1st Office Action of Chinese Patent Application 2017104817091.

*Primary Examiner* — Prabodh M Dharia
(74) *Attorney, Agent, or Firm* — Andrew C. Cheng

(57) ABSTRACT

A common voltage generating circuit is applied to a liquid crystal display circuit and includes M common voltage generating sub-circuits. The liquid crystal display circuit includes a data-driving chip, a row-driving chip, a thin film transistor (TFT) array, and a liquid crystal unit array corresponding to the TFT array. The row-driving chip is used to for opening the TFT array row-by-row through scanning lines. The data-driving chip is used for charging one row of the liquid crystal unit corresponding one row of TFT through data lines. N input terminals of a first common voltage generating sub-circuit respectively connect with adjacent N data lines output from the data-driving chip, an output terminal of the first common voltage generating sub-circuit connects with a common terminal of the liquid crystal unit corresponding to the N data lines, N is an even number.

15 Claims, 4 Drawing Sheets

(52) U.S. Cl.
CPC ..... *G09G 3/3688* (2013.01); *G09G 3/3666* (2013.01); *G09G 2320/0247* (2013.01)

(56) References Cited

U.S. PATENT DOCUMENTS

| | | | | |
|---|---|---|---|---|
| 7,746,302 | B2 * | 6/2010 | Lee | G09G 3/3655 345/87 |
| 10,207,315 | B2 * | 2/2019 | Appleby | B22C 9/04 |
| 2003/0090614 | A1 * | 5/2003 | Kim | G09G 3/3688 349/149 |
| 2007/0018926 | A1 * | 1/2007 | Shin | G02F 1/1345 345/92 |
| 2007/0080905 | A1 * | 4/2007 | Takahara | G09G 3/3233 345/76 |
| 2008/0001894 | A1 * | 1/2008 | Oh | G09G 3/3677 345/98 |
| 2008/0186308 | A1 * | 8/2008 | Suzuki | H04N 13/398 345/419 |
| 2010/0315400 | A1 * | 12/2010 | Choi | G02F 1/13452 345/211 |
| 2011/0032241 | A1 * | 2/2011 | Jeong | G09G 3/3614 345/212 |
| 2015/0080077 | A1 * | 3/2015 | Miller | A63F 1/18 463/11 |
| 2016/0034082 | A1 * | 2/2016 | Zhang | G09G 3/36 345/173 |
| 2016/0042216 | A1 * | 2/2016 | Yang | G06K 9/0002 382/124 |
| 2018/0158428 | A1 * | 6/2018 | Liu | G09G 3/3685 |

FOREIGN PATENT DOCUMENTS

| | | | |
|---|---|---|---|
| CN | 104795035 | A | 7/2015 |
| CN | 105334651 | A | 2/2016 |
| KR | 20010073557 | A | 8/2001 |
| TW | 200826040 | A | 6/2008 |

* cited by examiner

COMMON VOLTAGE GENERATING CIRCUIT AND LCD

CROSS-REFERENCE TO RELATED APPLICATIONS

The present application claims the priority benefit of application serial No. 201710481709.1, entitled "Common Voltage Generating Circuit and Liquid Crystal Display", filed on Jun. 22, 2017, which is incorporated herein by reference for all purposes and fully set forth herein.

BACKGROUND OF THE INVENTION

Field of Invention

The present invention relates to the field of liquid crystal display, and more particularly to a common voltage generating circuit and LCD.

Description of Prior Art

As the liquid crystal molecules could not be fixed at a specific voltage with a long time, the current liquid crystal display (LCD) module usually apply a AC drive method, that is, the positive-polarity voltage and the negative-polarity voltage alternatively charge the liquid crystal unit. As a result of the liquid crystal panel manufacturing process, the positive-polarity voltage and the negative-polarity voltage are easily to have asymmetry phenomenon, at this time, the display will flash.

In order to reduce the flicker of the display, a common voltage is introduced, to make a difference between the positive-polarity voltage and the common voltage is equal to a difference between the common voltage and negative-polarity voltage, which is capable of reducing the flicker of the display. However, due to the different areas of the display have different levels of flicker, and the common voltage has only one, hence, it is only possible to ensure that the flicker of some areas is low, not to guarantee that the flicker of the entire display is low.

SUMMARY OF THE INVENTION

The present invention provides a common voltage generating circuit and a liquid crystal display, which is capable of reducing the degree of flicker of the whole liquid crystal display and improving the display effect.

A first aspect of the present invention provides a common voltage generating circuit, wherein the common voltage generating circuit is applied to a liquid crystal display circuit, which comprises a data-driving chip, a row-driving chip, a thin film transistor (TFT) array, and a liquid crystal unit array corresponding to the TFT array. The row-driving chip is used to for opening the TFT array row-by-row through scanning lines. The data-driving chip is used for charging one row of the liquid crystal unit corresponding one row of TFT through data lines, when the row of TFT is turned on. The TFT array comprises P columns TFT.

The common voltage generating circuit comprises M common voltage generating sub-circuits. N input terminals of a first common voltage generating sub-circuit respectively connect with adjacent N data lines output from the data-driving chip, an output terminal of the first common voltage generating sub-circuit connects with a common terminal of the liquid crystal unit corresponding to the N data lines. M is a positive integer, N is an even number, and M is smaller than P, N is smaller than P. The first common voltage generating sub-circuit is any one of the M common voltage generating sub-circuits.

The first common voltage generating sub-circuit is used for acquiring an average value of the sustain voltages of the N data lines at a gap time between adjacent two frames and outputting the average value to the common terminal of the liquid crystal unit corresponding to the N data lines.

Wherein the first common voltage generating sub-circuit comprises a voltage follower and N switch tubes. Gate electrodes of the N switch tubes are connected with a control terminal of the data-driving chip, source electrodes of the N switch tubes respectively are connected with the N data lines, and drain electrodes of the N switch tubes are connected with a non-inverting input terminal of the voltage follower. An inverting input terminal of the voltage follower is connected with an output terminal of the voltage follower; the output terminal of the voltage follower is connected with the common terminal of the liquid crystal unit corresponding to the N data lines.

Wherein the first common voltage generating sub-circuit comprises a voltage follower and N switch tubes. Gate electrodes of the N switch tubes are connected with a control terminal of the data-driving chip, source electrodes of the N switch tubes respectively are connected with the N data lines. A drain electrode of a first switch tube is connected with a non-inverting input terminal of the voltage follower, the first switch tube is one of the N switch tubes, and a source electrode of the first switch tube is connected with other source electrodes of the N switch tubes excluding the first switch tube. An inverting input terminal of the voltage follower is connected with an output terminal of the voltage follower; the output terminal of the voltage follower is connected with the common terminal of the liquid crystal unit corresponding to the N data lines.

Wherein the control terminal of the data-driving chip outputs an effective control signal to control the N switch tubes to be turned on at the gap time between adjacent two frames.

Wherein N is equal to 2.

Wherein the switch tubes are a metal oxide semiconductor field effect transistor.

Wherein the liquid crystal display circuit is a column-inversion display circuit, voltages of the liquid crystal unit corresponding to any two adjacent columns TFT of the TFT array have opposite polarities.

A second aspect of the present invention provides a LCD comprising a common voltage generating circuit as above mentioned.

In the present embodiment, the common voltage generating circuit is applied to a liquid crystal display circuit, which comprises a data-driving chip, a row-driving chip, a thin film transistor (TFT) array, and a liquid crystal unit array corresponding to the TFT array. The row-driving chip is used to for opening the TFT array row-by-row through scanning lines. The data-driving chip is used for charging one row of the liquid crystal unit corresponding one row of TFT through data lines, when the row of TFT is turned on. The common voltage generating circuit comprises M common voltage generating sub-circuits. N input terminals of a first common voltage generating sub-circuit (any one of the M common voltage generating sub-circuits) respectively connect with adjacent N data lines output from the data-driving chip, an output terminal of the first common voltage generating sub-circuit connects with a common terminal of the liquid crystal unit corresponding to the N data lines. N is an even number. The first common voltage generating sub-circuit is used for acquiring an average value of the sustain voltages of the N data lines at a gap time between adjacent two frames and outputting the average value to the common terminal of the liquid crystal unit corresponding to the N data lines. The common voltage generating circuit of the embodiment of the present invention can adjust the common voltage of the liquid crystal unit corresponding to the N data lines at the gap time between adjacent two frames, the common voltage is calibrated at each frame to reduce the flicker of the display region corresponding to the liquid crystal display units with respect to the N data lines, thereby reducing the flicker value of the entire LCD and improving the display performance.

BRIEF DESCRIPTION OF THE DRAWINGS

In order to more clearly illustrate the embodiments of the present invention or the technical solutions in the conventional art, the following drawings, which are to be used in the description of the embodiments or the conventional art, will be briefly described. It will be apparent that the drawings in the following description are some embodiments of the present invention, and other drawings may be obtained by those skilled in the art without departing from the inventive work.

DETAILED DESCRIPTION OF THE PREFERRED EMBODIMENTS

Figure 1:
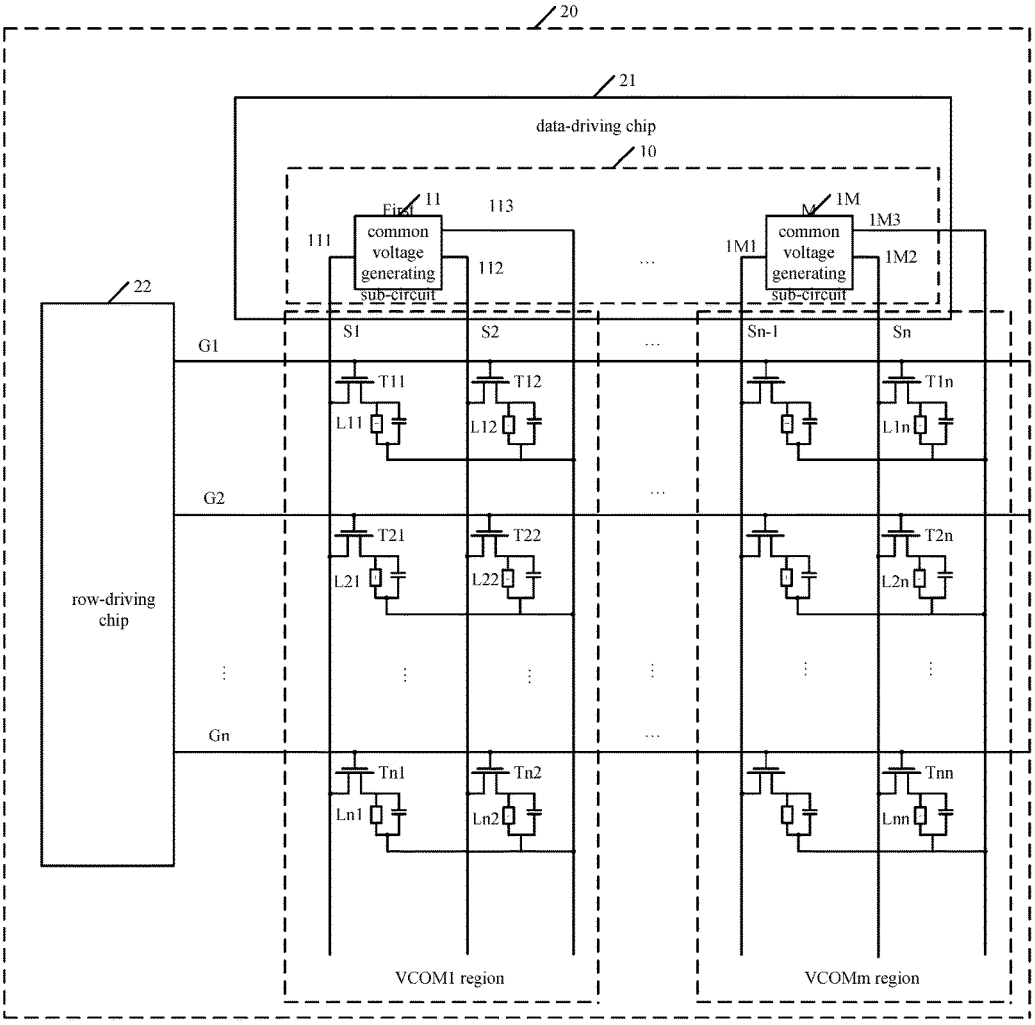
FIG. 1 is a schematic structural drawing of a common voltage generating circuit disclosed in an embodiment of the present invention.

The technical solutions in the embodiments of the present invention will be described in detail below in connection with the drawings in the embodiments of the present invention. Obviously, the described embodiments are part of the embodiments of the present invention, and not all embodiments. All other embodiments obtained by those skilled in the art without departing from the inventive work of the present invention are intended to be within the scope of the present invention, based on the embodiments of the invention.

In addition, the following description of the embodiments is directed to the appended drawings for illustrating specific embodiments in which the invention may be practiced. In the present invention, the terms, for example, "up", "down", "front", "rear", "left", "right", "inside", "outside", "side" is to refer to the direction of the additional schema, and therefore the direction of the language used is for the purpose of better and more clearly illustrating and understanding the invention, rather than indicating or implied that the device or element referred to must have a specific orientation in a particular orientation for construction and operation, and therefore could not be construed as limiting the present invention.

In the description of the present invention, the terms "install", "connect", "link" should be broadly understood, unless otherwise specified and defined. For example, a fixed connection, a removable connection or integral connection; mechanical connection; direct connection, or indirect connection through an intermediate medium, or internal connection of two components. It will be apparent to those skilled in the art that the specific meaning of the above terms in the present invention may be understood particularly.

In addition, in the description of the present invention, the meaning of "plural" is two or more, unless otherwise indicated. If the term "process" appears in this specification, it refers not only to an independent process, but also to the realization of the intended effect of the process when it is not clearly distinguishable from other processes. The numerical range indicated by "~" in the present specification means a range in which the values described before and after "~" are included as the minimum value and the maximum value, respectively. In the drawings, elements having similar or identical structures are denoted by the same reference numerals.

The embodiment of the present invention provides a common voltage generating circuit and a liquid crystal display (LCD), which is capable of reducing the flicker value of the entire LCD and improving the display effect, which will be described in detail below.

FIG. 1 is a schematic structural drawing of a common voltage generating circuit disclosed in an embodiment of the present invention. As FIG. 1 shown, the common voltage generating circuit 10 described in the embodiment is applied to a liquid crystal display circuit 20. The common voltage generating circuit 10 comprises M common voltage generating sub-circuits. For example, the M common voltage generating sub-circuits comprises a first common voltage generating sub-circuit 11, an M common voltage generating sub-circuit 1M and etc. The liquid crystal display circuit 20 comprises a data-driving chip 21 and a row-driving chip 22, a thin film transistor (TFT) array (it is not specific shown in FIG. 1, specifically, as the TFT T11, the TFT T12, the TFT T21, the TFT T22), and a liquid crystal unit array (it is not specific shown in FIG. 1, specifically, as the liquid crystal unit L11, the liquid crystal unit L12, the liquid crystal unit L21, the liquid crystal unit L22) corresponding to the TFT array. The row-driving chip 22 is used to for opening the TFT array row-by-row through scanning lines (As the scanning line G1, the scanning line G2, . . . the scanning line Gn in FIG. 1). The data-driving chip 21 is used for charging one row of the liquid crystal unit corresponding one row of TFT (for example, the first TFT row: TFT T11, TFT12 . . . TFT T1*n*) through data lines (As the data line S1, the data line S2, . . . the data line Sn in FIG. 1), when the row of TFT is turned on. The TFT array comprises P columns TFT.

The first common voltage generating sub-circuit is any one of the M common voltage generating sub-circuits. The first common voltage generating sub-circuit comprises N input terminals and an output terminal. The N input terminals of the first common voltage generating sub-circuit respectively connect with adjacent N data lines output from the data-driving chip. The output terminal of the first common voltage generating sub-circuit connects with a common terminal of the liquid crystal unit corresponding to the N data lines. M is a positive integer, N is an even number, and M is smaller than P, N is smaller than P.

The first common voltage generating sub-circuit is used for acquiring an average value of the sustain voltages of the N data lines at a gap time between adjacent two frames and outputting the average value to the common terminal of the liquid crystal unit corresponding to the N data lines.

In the embodiment, the data lines S1, S2, . . . Sn outputted from the data-driving chip 21, as shown in FIG. 1, the data line S1 corresponds to the TFT column of the TFT T11, the TFT T21, . . . , the TFT Tn1, the data line S2 corresponds to the TFT column of the TFT T12, the TFT T22, . . . , the TFT Tn2, the data line Sn corresponds to the TFT column of the TFT T1*n*, the TFT T2*n*, . . . , the TFT Tnn. Each TFT corresponds to a liquid crystal unit. For example, the TFT T11 corresponds to the liquid crystal unit L11, the TFT T12 corresponds to the liquid crystal unit L12, the TFT T21 corresponds to the liquid crystal unit L21, the TFT T22 corresponds to the liquid crystal unit L22, and the TFT Tn1 corresponds to the liquid crystal unit Ln1 and so on.

The liquid crystal display circuit 20 in the embodiment of the present invention is used to control the ON/OFF of the TFTs of TFT array to realize charge/discharge of the liquid crystal unit. The driving of TFT array shown in FIG. 1 is illustrated by an example of n rows and n columns, and the embodiment of the present invention does not limit the number of rows and columns of the array TFT to be equal. In actual products, the number of rows and columns in the TFT array is generally not equal. For example, the TFT array may be 1080 rows and 1920 columns, 1366 rows and 768 columns, 1440 rows and 900 columns, 1600 rows and 900 columns, and so on. In the display process of one frame, the row-driving chip 21 opens each TFT row in a progressive scanning manner, and when each TFT row (e.g., the first TFT row: thin film transistor T11, thin film transistor T12, . . . , thin film transistor T1*n*), The data-driving chip 22 is charged by the liquid crystal unit L11, the liquid crystal unit L12, . . . , and the liquid crystal unit L1*n* through the data lines S1, S2, . . . , Sn, respectively. When the liquid crystal units corresponding to all the TFT rows on the liquid crystal display screen are charged, the display of one frame is completed. Then, the liquid crystal display circuit 20 prepares to update the voltage output from the data line for the next frame (preparation for the display of the next frame), and then starts the display of the next frame. In general, there is a time gap between adjacent two frames for preparing the voltage of the data line for the next frame.

If the entire LCD screen using the same common voltage VCOM, due to VCOM trace impedance and other reasons, at the middle of the screen and the two side regions, the charging effects are different and the flashing effects are different, resulting the flashing in the screen. Thus, an embodiment of the present invention provides a common voltage generating circuit for solving the above problems.

In the embodiment of the present invention, the common voltage generating circuit applied to the liquid crystal display circuit 20 may have a plurality of sub-circuits, and the common voltage generating circuit may be disposed in the data driving chip. In FIG. 1, takes M (M is a positive integer, M is smaller than P) common voltage generating sub-circuits for example (the common voltage generation sub-circuit 11, . . . , and the M common voltage generation sub-circuit 1M shown in FIG. 1). The liquid crystal display circuit 20 is a column-inversion display circuit, and the voltage of the liquid crystal unit corresponding to any adjacent two rows of TFTs in the TFT array have opposite polarities. As shown in FIG. 1, when the frame is displayed, the polarity of the liquid crystal units L11, L21, Ln1 correspond to the data lines S1 is positive, and polarity of the liquid crystal units L12 and L22 correspond to the adjacent data lines S2 is negative.

Any one of the common voltage generation sub-circuits shown in FIG. 1 is used to adjust the common voltage of the liquid crystal unit corresponding to the N (N is even) data lines. The number of adjacent data lines adjusted by each common voltage generation sub-circuit may be the same or different. For example, the first common voltage generating sub-circuit 11 is used to adjust the common voltage of the liquid crystal unit corresponding to the two data lines of the adjacent data line S1 and the data line S2, and the second common voltage generating sub-circuit is used to adjust the common voltage of the liquid crystal unit corresponding to the two data lines of the adjacent data line S3 and the data line S4 . . . the M common voltage generating sub-circuit 1M is used to adjust the common voltage of the liquid crystal unit corresponding to the two data lines of the data line Sn−1 and the data line Sn. Furthermore, the first common voltage generating sub-circuit 11 is used to adjust the common voltage of the liquid crystal unit corresponding to the two data lines of the adjacent data line S1 and the data line S2, and the second common voltage generating sub-circuit is used to adjust the common voltage of the liquid crystal unit corresponding to the two data lines of the adjacent data line S3, the data line S4, the data line S5, and the data line S6, as long as the number of adjacent data lines adjusted by each common voltage generating sub-circuit is even (i.e., N is even). In order to facilitate understanding of the technical solution of the present invention, below is an example that an arbitrary common voltage generating sub-circuit adjust two adjacent data lines (i.e., N=2).

Optionally, the first common voltage generating circuit 11 and the M common voltage generating circuit 1M respectively correspond to different VCOM regions, respectively. As shown in FIG. 1, the first common voltage generating circuit 11 corresponds to the VCOM1 region is used to adjust the common voltage of the liquid crystal unit of the VCOM1 region (the liquid crystal unit corresponding to the data line S1 and the data line S2), the M common voltage generating circuit 1M corresponds to the VCOMm region is used to adjust the common voltage of the liquid crystal unit of the VCOMm region (the liquid crystal unit corresponding to the data line Sn−1 and the data line Sn) corresponds to the VCOMm region for adjusting the liquid crystal unit in the VCOMm region (i.e., the data line Sn−1 and the data line Sn corresponding to the liquid crystal unit). Alternatively, the common voltage of the liquid crystal unit of the VCOM1 region is not the same as the common voltage of the liquid crystal unit of the VCOMm region.

The operation principle of the common voltage generating circuit will be described below with reference to the first common voltage generating sub-circuit 11 as an example. The first common voltage generating sub-circuit 11 comprises two input terminals (input terminal 111 and input terminal 112 as shown in FIG. 1) and an output terminal 113. The input terminal 111 is connected with the data line S1 outputted from the data-driving chip, the input terminal 112 is connected with the data line S2 outputted from the data-driving chip, and the output terminal 113 of the first common voltage generating sub-circuit 11 is connected with the common terminal VCOM1 of the liquid crystal unit corresponding to the data line S1 and the data line S2. In the display process of one frame, the row-driving chip 22 is scanned row-by-row through the scanning lines G1, G2 and Gn, and the data-driving chip respectively charges the first TFT column (the thin film transistor T11, the thin film transistor T21, . . . the thin film transistor Tn1 as shown in FIG. 1) and the second TFT column (thin film transistor T12, the thin film transistor T22, . . . , the thin film transistor Tn2 as shown in FIG. 1) through the data line S1 and the data line S2. After the completion of the above-mentioned display of one frame, the row-driving chip 22 turns off the output and all the TFTs are turned off. In this case, although the data lines S1 and the data line S2 could not output the voltage to the liquid crystal unit, the data lines S1 and the data lines S2 still keep the voltage of last frame, then, the first common voltage generating sub-circuit 11 acquires the hold voltage V1 of the data line S1 and the hold voltage V2 of the data line S2, and outputs a mean value of the hold voltage V1 of the data line S1 and the hold voltage V2 of the data line S2 to the common terminal of the liquid crystal unit corresponding to the data line S1 and the data line S2. Therefore, when the next frame is displayed, the common voltage of the common terminal of the liquid crystal unit corresponding to the data line S1 and the data line S2 is VCOM1=(V1+V2)/2.

The first common voltage generating sub-circuit 11 in the embodiment of the present invention can adjust the common voltage of the liquid crystal display unit corresponding to the data line S1 and the data line S2 at the gap time between every two frames, and before the display of each frame The common voltage of the liquid crystal unit (i.e., the liquid crystal unit corresponding to the data line S1 and the data line S2) in the VCOM1 region (the area corresponding to the first column TFT and the second column TFT shown in FIG. 1) is calibrated to reduce flicker of the VCOM1 region, thereby reducing the entire LCD flashing value, improve the display performance.

For the sake of understanding, the following common voltage generating circuits are described by taking the first common voltage generating sub-circuit 11 as an example.

Figure 2:
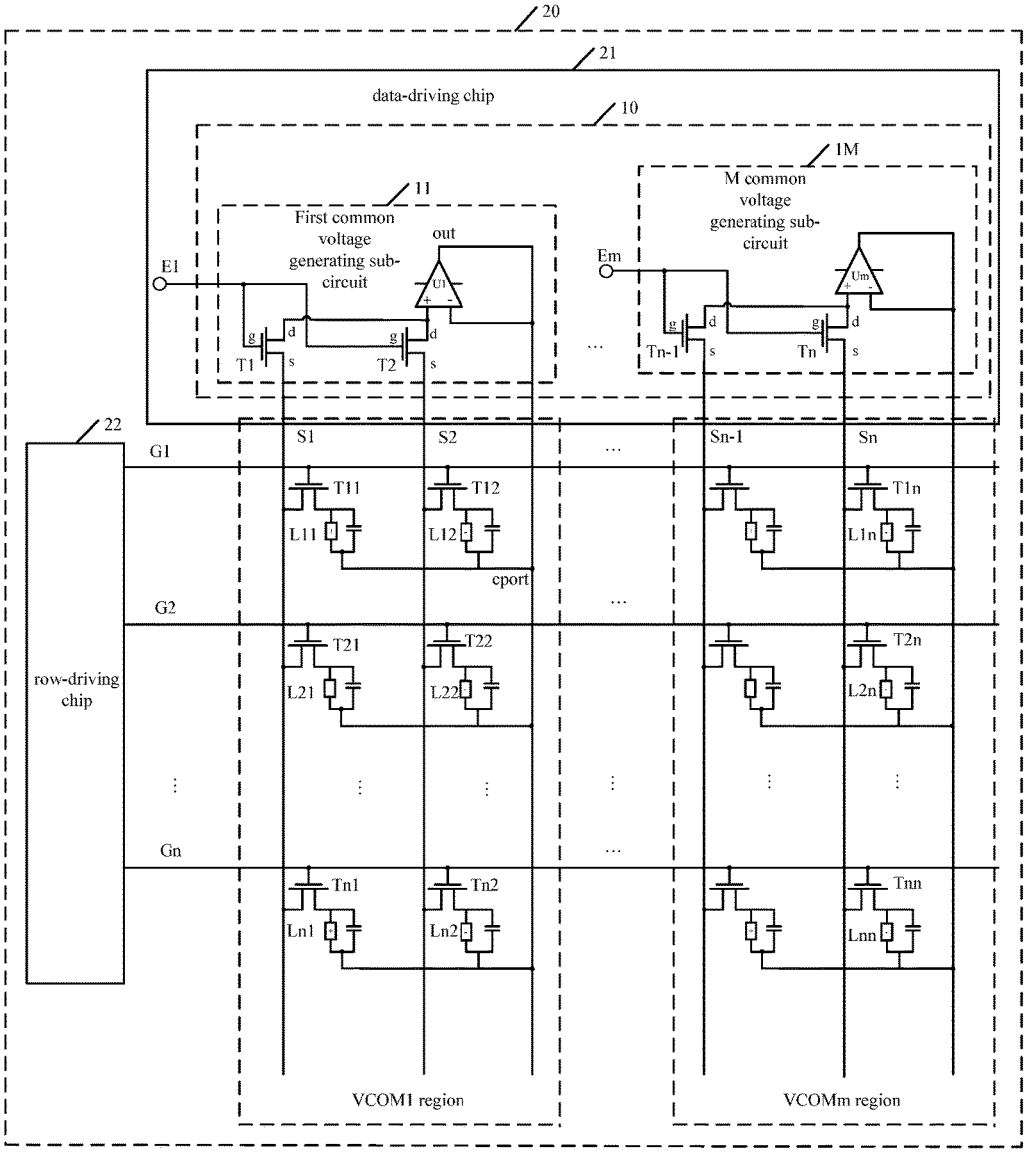
FIG. 2 is a specific schematic structural drawing of a common voltage generating circuit disclosed in an embodiment of the present invention.

Optionally, FIG. 2 is a specific schematic structural drawing of a common voltage generating circuit disclosed in an embodiment of the present invention. As shown in FIG. 2, the first common voltage generating sub-circuit 11 comprises a voltage followers U1 and 2 switch tubes (the switch tube T1 and the switch tube T2 shown in FIG. 2), the gate electrodes g of the switch gate T1 and the switch tube T2 are both connected with a control terminal E1 of the data-driving chip 21. The source electrodes s of the switch T1 and the switch tube T2 are respectively connected with the data line S1 and the data line S2, and the drain electrodes d of the switch tube T1 and the switch tube T2 are connected with a non-inverting input terminal of the voltage follower U1. An inverting input terminal of the voltage follower U1 is connected with an output terminal of the voltage follower U1, and the output terminal of the voltage follower is connected with the common terminal cport of the liquid crystal unit corresponding to the data line S1 and the data line S2 (the data lines S1 corresponds to the liquid crystal units L11, L21, . . . , Ln1; the data line S2 corresponds to the liquid crystal units L12, L22, . . . , Ln2).

The output of the voltage follower U1 always follows the non-inverting input terminal of the voltage follower U1, in other words, the voltage at the output terminal out of the voltage follower U1 shown in FIG. 2 is equal to the voltage at the non-inverting input terminal of the voltage follower U1. When both the switch tube T1 and the switch tube T2 are turned on, the non-inverting input terminal of the voltage follower U1 is conducted to the data line S1 and the data line S2 at the same time. All of the scanning lines (G1, G2, . . . Gn) could not open the TFTs in the VCOM1 region because the row-driving chip 22 turns off the output at the gap time between two frames, and the TFTs in the VCOM1 region comprises the first TFT column and the second TFT column, the first TFT column includes T11, T21, . . . , Tn1; and the second TFT column includes T12, T22, . . . , Tn2.

The hold voltage of the data line S1 and the data line S2 could not charge the liquid crystal units corresponding to the first TFT column and the second TFT column through the first TFT column and the second TFT column, although the data lines S1 and the data line S2 still hold the voltage of the previous frame at the gap time between two frames. At this time, the control terminal E1 of the data-driving chip 21 outputs an effective control signal to open the switch tube T1 and the switch tube T2, the hold voltage V1 of the data line S1 and the hold voltage V2 of the data line S2 are short-circuited and outputted to the non-inverting input terminal of the voltage follower U1. The hold voltage V1 of the data line S1 and the hold voltage V2 of the data line S2 are short-circuited, in other words, corresponding to two voltage sources (the voltage source of voltage V1 and the voltage source of voltage V2) are connected in parallel. Theoretically, it can be understood as the two capacitors which have the same capacitance are connected in parallel, the parallel voltage is an average voltage at both ends of the capacitors. The following is a popular way to explain the principle of voltage average: a capacitor C1 has a capacitance C, a voltage V1, and an electric quantity Q1; a capacitor C2 has a capacitance C, a voltage V2, and an electric quantity Q2. It can be understood that the electric quantity is water within a barrel, the capacitor is a cross-sectional area of the barrel, and the voltage is a water level inside the barrel. if the capacitor C1 and capacitor C2 are connected in parallel, it is the same as to connect the two barrels via a water tube, then, the water level of the two barrels is the same, that is, the voltage of the capacitor C1 and the voltage of the capacitor C2 are the same after connecting in parallel and is equal to the average value of V1 and V2. For example, if the capacitance C1 and the capacitance C2 are both 1 μF, the voltage of the capacitor C1 is 13 volts and the voltage of the capacitor C2 is 1 volts before connecting in parallel, then the capacitor C1 charges the capacitor C2, the voltage of the capacitor C1 decreases and the voltage of the capacitor C2 rises until the voltages are equal, i.e., the voltage of the capacitor C1 and the voltage of the capacitor C2 are the same and equal to 7 volts.

Since the output terminal of the voltage follower U1 follows the non-inverting input terminal of the voltage follower U1, the output terminal of the voltage follower U1 outputs the average value of the hold voltage V1 of the data line S1 and the hold voltage V2 of the data line S2 to the common terminal cport of the liquid crystal unit corresponding to the data line S1 the data line S2 (the data line S1 corresponds to the liquid crystal unit L11, L21, . . . , Ln1; the data line S2 corresponds to the liquid crystal units L12, L22, . . . , Ln2).

When entering the display time of a certain frame, the control terminal E1 of the data-driving chip 21 outputs an invalid control signal which could not open the switch tube T1 and the switch tube T2, so that the data line S1 is disconnected from the data line S2, in other words, the data line S1 and the data line S2 are disconnected (as mentioned before, at the gap time between two frames, the effective control signal outputted from the control terminal E1 of the data-driving chip 21 could open the switch tube T1 and the switch tube T2), so that no interference is caused between the data lines of the adjacent two columns, and the liquid crystal display circuit 20 normally displays. The voltage outputted by the first common voltage generating sub-circuit 11 still keep the voltage output from the first common voltage generating sub-circuit 11 at the gap between the previous frame and the present frame. It ensures that the first common voltage generating sub-circuit 11 does not interfere with the normal screen display of the liquid crystal display circuit 20.

Figure 3:
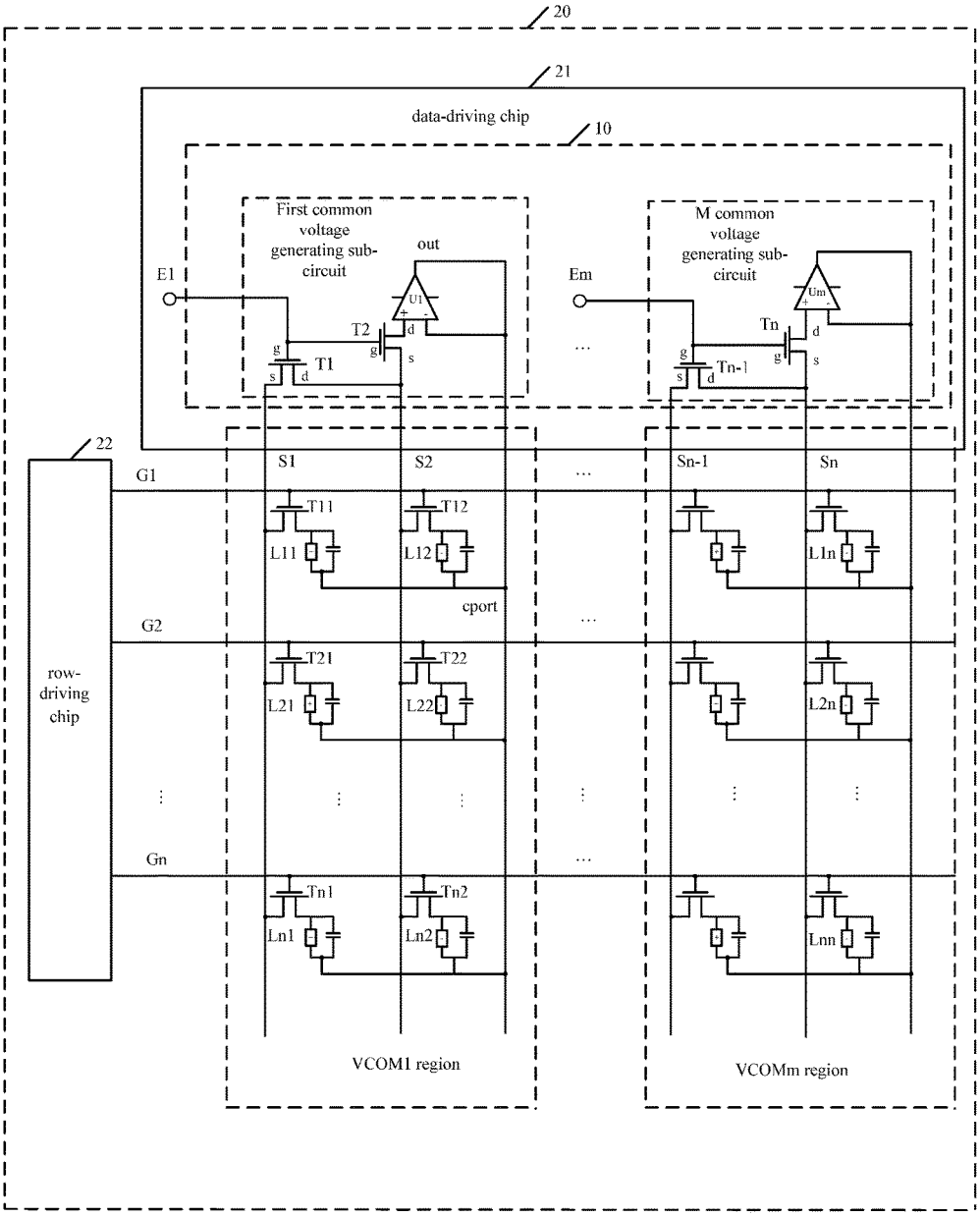
FIG. 3 is another schematic structural drawing of another common voltage generating circuit disclosed in the embodiments of the present invention.

Optionally, FIG. 3 is another schematic structural drawing of another common voltage generating circuit disclosed in the embodiments of the present invention. As shown in FIG.

3, the first common voltage generating sub-circuit 11 comprises a voltage follower U1 and two switch tubes (switch tube T1 and switch tube T2 shown in FIG. 3). Gate electrodes of the switch tube T1 and the switch tube T2 are both connected with a control terminal E1 of the data-driving chip 21, source electrodes s of the switch tube T1 and the switch tube T2 are respectively connected with the data line S1 and the data line S2, a drain electrode d of the switch tube T2 is connected with a non-inverting input terminal of the voltage follower U1, and the source electrode s of the switch tube T2 is connected with a drain electrode d of the switch tube T1. An inverting input terminal of the voltage follower U1 is connected with an output terminal out of the voltage follower U1. The output terminal out of the voltage follower U1 is connected with a common terminal cport of the liquid crystal units corresponding to the data line S1 and the data line S2 (the data line S1 corresponds to the liquid crystal units L11, L21, . . . , Ln1; the data line S2 corresponds to the liquid crystal units L12, L22, . . . , Ln2).

Wherein the voltage at the output terminal out of the voltage follower U1 shown in FIG. 3 is equal to the voltage of the non-inverting input terminal of the voltage follower U1. When both the switch tube T1 and the switch tube T2 are turned on, the non-inverting input terminal of the voltage follower U1 is simultaneously conducted with the data line S1 and the data line S2. All of the scanning lines (G1, G2, . . . Gn) could not open the TFTs in the VCOM1 region because the row-driving chip 22 turns off the output at the gap time between two frames, and the TFTs in the VCOM1 region include the first TFT column and the second TFT column, the first TFT column includes T11, T21, . . . , Tn1; and the second TFT column includes T12, T22, . . . , Tn2.

The hold voltage of the data line S1 and the data line S2 could not charge the liquid crystal units corresponding to the first TFT column and the second TFT column through the first TFT column and the second TFT column, although the data lines S1 and the data line S2 still hold the voltage of the previous frame at the gap time between two frames. At this time, the control terminal E1 of the data-driving chip 21 outputs an effective control signal to open the switch tube T1 and the switch tube T2, the hold voltage V1 of the data line S1 and the hold voltage V2 of the data line S2 are short-circuited and outputted to the source electrode of the switch tube T2, then outputting to the non-inverting input terminal of the voltage follower U1 through the drain electrode of the switch tube T2. The hold voltage V1 of the data line S1 and the hold voltage V2 of the data line S2 are short-circuited, in other words, corresponding to two voltage sources (the voltage source of voltage V1 and the voltage source of voltage V2) are connected in parallel. Theoretically, it can be understood as the two capacitors which have the same capacitance are connected in parallel, the parallel voltage is an average voltage at both ends of the capacitors. The following is a popular way to explain the principle of voltage average: a capacitor C1 has a capacitance C, a voltage V1, and an electric quantity Q1; a capacitor C2 has a capacitance C, a voltage V2, and an electric quantity Q2. It can be understood that the electric quantity is water within a barrel, the capacitor is a cross-sectional area of the barrel, and the voltage is a water level inside the barrel. if the capacitor C1 and capacitor C2 are connected in parallel, it is the same as to connect the two barrels via a water tube, then, the water level of the two barrels is the same, that is, the voltage of the capacitor C1 and the voltage of the capacitor C2 are the same after connecting in parallel and is equal to the average value of V1 and V2. For example, if the capacitance C1 and the capacitance C2 are both 1 μF, the voltage of the capacitor C1 is 13 volts and the voltage of the capacitor C2 is 1 volts before connecting in parallel, then the capacitor C1 charges the capacitor C2, the voltage of the capacitor C1 decreases and the voltage of the capacitor C2 rises until the voltages are equal, i.e., the voltage of the capacitor C1 and the voltage of the capacitor C2 are the same and equal to 7 volts.

Since the output terminal of the voltage follower U1 follows the non-inverting input terminal of the voltage follower U1, the output terminal of the voltage follower U1 outputs the average value of the hold voltage V1 of the data line S1 and the hold voltage V2 of the data line S2 to the common terminal cport of the liquid crystal unit corresponding to the data line S1 the data line S2 (the data line S1 corresponds to the liquid crystal unit L11, L21, . . . , Ln1; the data line S2 corresponds to the liquid crystal units L12, L22, . . . , Ln2).

When entering the display time of a certain frame, the control terminal E1 of the data-driving chip 21 outputs an invalid control signal which could not open the switch tube T1 and the switch tube T2, so that the data line S1 is disconnected from the data line S2, and the liquid crystal display circuit 20 normally displays. The voltage outputted by the first common voltage generating sub-circuit 11 still keep the voltage output from the first common voltage generating sub-circuit 11 at the gap between the previous frame and the present frame. It ensures that the first common voltage generating sub-circuit 11 does not interfere with the normal screen display of the liquid crystal display circuit 20.

Optionally, the switch tube T1 and the switch tube T2 may be metal oxide semiconductor field effect transistors, i.e., MOS tubes. When the MOS tubes are an NMOS transistors, the control terminal E1 of the data-driving chip 21 outputs an effective control signal (for example, a high level signal) to control the switch tube T1 and the switch tube T2 to turn on; when the MOS tubes are PMOS tubes, the control terminal E1 of the data-driving chip 21 outputs an effective control signal (for example, a low level signal) to control the switch T1 and switch T2 to turn on.

Figure 4:
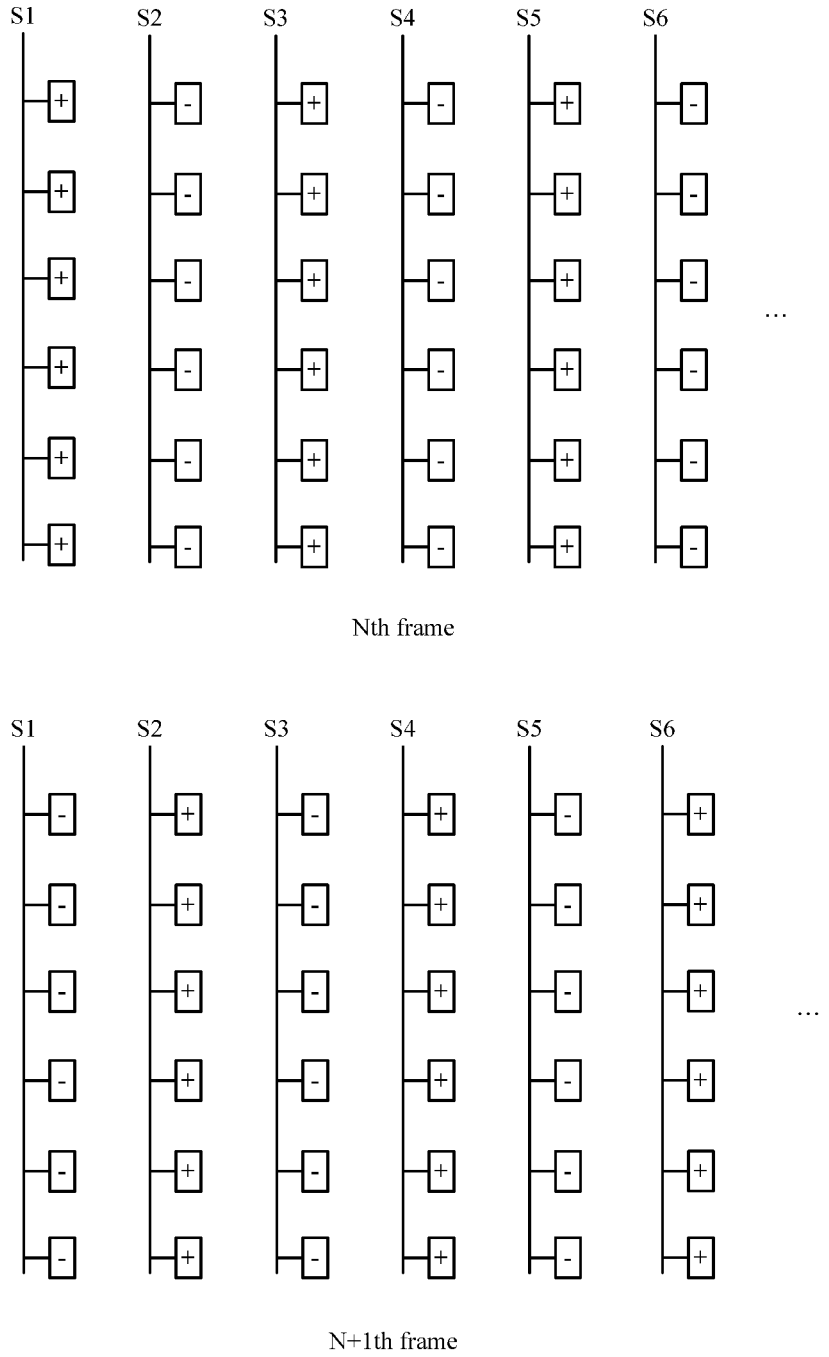
FIG. 4 is a vibration schematic drawing of the polarity of voltage of a liquid crystal unit array disclosed in the embodiments of the present invention.

Optionally, the liquid crystal display circuit 20 is a column-inversion display circuit; voltages of the liquid crystal unit corresponding to any two adjacent columns TFT of the TFT array have opposite polarities. FIG. 4 is a vibration schematic drawing of the polarity of voltage of a liquid crystal unit array disclosed in the embodiments of the present invention. In the Nth frame, the polarity of the voltage of the first column of the liquid crystal unit corresponding to the data line S1 is positive, the polarity the voltage of the second column of liquid crystal unit corresponding to the data line S2 is negative, the polarity of the voltage of the third column of the liquid crystal unit corresponding to the data line S3 is positive, the polarity of the voltage of the fourth column of liquid crystal unit corresponding to the data line S4 is negative, and so on. In the N+1th frame, the polarity of the voltage of the first column of the liquid crystal unit corresponding to the data line S1 is negative, the polarity the voltage of the second column of liquid crystal unit corresponding to the data line S2 is positive, the polarity of the voltage of the third column of the liquid crystal unit corresponding to the data line S3 is negative, the polarity of the voltage of the fourth column of liquid crystal unit corresponding to the data line S4 is positive, and so on.

The embodiment of the present invention also provides a liquid crystal display, which comprises a common voltage generating circuit as shown in any one of FIGS. 1, 2, and 3.

Please refer to the above description of the common voltage generating circuit shown in FIGS. 1-4, which will not be described here.

In the description of this specification, the description of the terms "one embodiment", "some embodiments", "examples", "specific examples" or "some examples" and the like is intended to be a combination of the specific features described in connection with the embodiments or examples, Structure, material, or characteristic is included in at least one embodiment or example of the present invention. In the present specification, the schematic expression of the above-mentioned terminology does not necessarily refer to the same embodiment or example. Moreover, the particular features, structures, materials, or features described may be combined in any suitable embodiment or example in any suitable manner.

As mentioned above, a detail description has been given to the common voltage generating circuit and the LCD provided in the embodiments of the present invention. The principles and embodiments of the present invention have been described with reference to specific examples in the document. The description of the above embodiments is merely for explaining the understanding of the present invention method and its core idea. Meanwhile, it will be understood by those skilled in the art will has change on the specific embodiments and application scope, according to the idea of the present invention, as mentioned above, the contents of this specification should not be construed as the limitations of the invention.

What is claimed is:

1. A common voltage generating circuit, applicable to a liquid crystal display circuit, the common voltage generating circuit comprising a data-driving chip, a row-driving chip, a thin film transistor (TFT) array, and a liquid crystal unit array corresponding to the TFT array, wherein the row-driving chip is used for opening the TFT array row-by-row through scanning lines; the data-driving chip is used for charging one row of the liquid crystal unit corresponding one row of TFT through data lines, when the row of TFT is turned on; and the TFT array comprises P columns TFT;

wherein the common voltage generating circuit comprises M common voltage generating sub-circuits, wherein N input terminals of a first common voltage generating sub-circuit respectively connect with adjacent N data lines output from the data-driving chip, and an output terminal of the first common voltage generating sub-circuit connects with a common terminal of the liquid crystal unit corresponding to the N data lines, wherein M is a positive integer, N is an even number, and M is smaller than P, N is smaller than P; the first common voltage generating sub-circuit is one of the M common voltage generating sub-circuits;

wherein the first common voltage generating sub-circuit is used for acquiring an average value of the sustain voltages of the N data lines at a gap time between adjacent two frames and outputting the average value to the common terminal of the liquid crystal unit corresponding to the N data lines; and wherein the first common voltage generating sub-circuit comprises a voltage follower and N switch tubes, gate electrodes of the N switch tubes are connected with a control terminal of the data-driving chip, source electrodes of the N switch tubes respectively are connected with the N data lines, and drain electrodes of the N switch tubes are connected with a non-inverting input terminal of the voltage follower, an inverting input terminal of the voltage follower is connected with an output terminal of the voltage follower, the output terminal of the voltage follower is connected with the common terminal of the liquid crystal unit corresponding to the N data lines.

2. The common voltage generating circuit according to claim 1, wherein the control terminal of the data-driving chip outputs an effective control signal to control the N switch tubes to be turned on at the gap time between adjacent two frames.

3. The common voltage generating circuit according to claim 2, wherein N is equal to 2.

4. The common voltage generating circuit according to claim 1, wherein N is equal to 2.

5. The common voltage generating circuit according to claim 1, wherein the switch tubes are a metal oxide semiconductor field effect transistor.

6. The common voltage generating circuit according to claim 1, wherein the liquid crystal display circuit is a column-inversion display circuit, voltages of the liquid crystal unit corresponding to any two adjacent columns TFT of the TFT array have opposite polarities.

7. A common voltage generating circuit, applicable to a liquid crystal display circuit, the common voltage generating circuit comprising a data-driving chip, a row-driving chip, a thin film transistor (TFT) array, and a liquid crystal unit array corresponding to the TFT array, wherein the row-driving chip is used for opening the TFT array row-by-row through scanning lines; the data-driving chip is used for charging one row of the liquid crystal unit corresponding one row of TFT through data lines, when the row of TFT is turned on; and the TFT array comprises P columns TFT;

wherein the common voltage generating circuit comprises M common voltage generating sub-circuits, wherein N input terminals of a first common voltage generating sub-circuit respectively connect with adjacent N data lines output from the data-driving chip, and an output terminal of the first common voltage generating sub-circuit connects with a common terminal of the liquid crystal unit corresponding to the N data lines, wherein M is a positive integer, N is an even number, and M is smaller than P, N is smaller than P; the first common voltage generating sub-circuit is one of the M common voltage generating sub-circuits;

wherein the first common voltage generating sub-circuit is used for acquiring an average value of the sustain voltages of the N data lines at a gap time between adjacent two frames and outputting the average value to the common terminal of the liquid crystal unit corresponding to the N data lines;

wherein the first common voltage generating sub-circuit comprises a voltage follower and N switch tubes, gate electrodes of the N switch tubes are connected with a control terminal of the data-driving chip, source electrodes of the N switch tubes respectively are connected with the N data lines, and a drain electrode of a first switch tube is connected with a non-inverting input terminal of the voltage follower, the first switch tube is one of the N switch tubes, a source electrode of the first switch tube is connected with other source electrodes of the N switch tubes excluding the first switch tube, an inverting input terminal of the voltage follower is connected with an output terminal of the voltage follower, the output terminal of the voltage follower is connected with the common terminal of the liquid crystal unit corresponding to the N data lines.

8. The common voltage generating circuit according to claim 7, wherein the control terminal of the data-driving chip outputs an effective control signal to control the N switch tubes to be turned on at the gap time between adjacent two frames.

9. The common voltage generating circuit according to claim 8, wherein N is equal to 2.

10. The common voltage generating circuit according to claim 7, wherein N is equal to 2.

11. The common voltage generating circuit according to claim 7, wherein the liquid crystal display circuit is a column-inversion display circuit, voltages of the liquid crystal unit corresponding to any two adjacent columns TFT of the TFT array have opposite polarities.

12. A liquid crystal display (LCD), comprising a data-driving chip, a row-driving chip, a thin film transistor (TFT) array, and a liquid crystal unit array corresponding to the TFT array, wherein the row-driving chip is used for opening the TFT array row-by-row through scanning lines; the data-driving chip is used for charging one row of the liquid crystal unit corresponding one row of TFT through data lines, when the row of TFT is turned on; and the TFT array comprises P columns TFT;

wherein the LCD further comprises a common voltage generating circuit, which comprises M common voltage generating sub-circuits, wherein N input terminals of a first common voltage generating sub-circuit respectively connect with adjacent N data lines output from the data-driving chip, and an output terminal of the first common voltage generating sub-circuit connects with a common terminal of the liquid crystal unit corresponding to the N data lines, wherein M is a positive integer, N is an even number, and M is smaller than P, N is smaller than P; the first common voltage generating sub-circuit is one of the M common voltage generating sub-circuits;

wherein the first common voltage generating sub-circuit is used for acquiring an average value of the sustain voltages of the N data lines at a gap time between adjacent two frames and outputting the average value to the common terminal of the liquid crystal unit corresponding to the N data lines; and wherein the first common voltage generating sub-circuit comprises a voltage follower and N switch tubes, gate electrodes of the N switch tubes are connected with a control terminal of the data-driving chip, source electrodes of the N switch tubes respectively are connected with the N data lines, and a drain electrode of a first switch tube is connected with a non-inverting input terminal of the voltage follower, the first switch tube is one of the N switch tubes, a source electrode of the first switch tube is connected with other source electrodes of the N switch tubes excluding the first switch tube, an inverting input terminal of the voltage follower is connected with an output terminal of the voltage follower, the output terminal of the voltage follower is connected with the common terminal of the liquid crystal unit corresponding to the N data lines.

13. The LCD according to claim 12, wherein the control terminal of the data-driving chip outputs an effective control signal to control the N switch tubes to be turned on at the gap time between adjacent two frames.

14. The LCD according to claim 12, wherein N is equal to 2.

15. The LCD according to claim 12, wherein the liquid crystal display circuit is a column-inversion display circuit, voltages of the liquid crystal unit corresponding to any two adjacent columns TFT of the TFT array have opposite polarities.

* * * * *